US006062814A

United States Patent [19]

Bähr et al.

[11] Patent Number: 6,062,814

[45] Date of Patent: May 16, 2000

[54] TRANSITION ELEMENT BETWEEN COMPONENTS OF A FLUE-GAS DUCT OF A GAS TURBINE

[75] Inventors: Siegfried Bähr, Eggolsheim; Jens Rackow; Dirk Lorenz, both of Erlangen, all of Germany

[73] Assignee: Siemens Aktiengesellschaft, Munich, Germany

[21] Appl. No.: 09/070,402

[22] Filed: Apr. 30, 1998

Related U.S. Application Data

[63] Continuation of application No. PCT/DE96/01980, Oct. 17, 1996.

[30] Foreign Application Priority Data

Oct. 31, 1995 [DE] Germany ..... 195 40 606

[51] Int. Cl.[7] ..... F01D 25/08

[52] U.S. Cl. ..... 415/178; 415/176; 415/134; 415/214.1; 415/220

[58] Field of Search ..... 415/134, 177, 415/178, 175, 176, 220, 214.1; 60/39.32, 39.5; 285/47, 48, 50, 187, 332.2, 332.3

[56] References Cited

U.S. PATENT DOCUMENTS

| | | | |
|---|---|---|---|
| 2,710,523 | 6/1955 | Purvis . | |
| 4,047,742 | 9/1977 | Haferkamp et al. | 285/187 |
| 5,378,026 | 1/1995 | Ninacs et al. | 285/47 |
| 5,658,024 | 8/1997 | Bachmann et al. | 285/299 |
| 5,669,812 | 9/1997 | Schockemoehl et al. | 454/45 |

FOREIGN PATENT DOCUMENTS

| | | |
|---|---|---|
| 0345700A1 | 12/1989 | European Pat. Off. . |
| 2378176 | 8/1978 | France . |
| 2469563 | 5/1981 | France . |
| 2528084 | 1/1976 | Germany . |

*Primary Examiner*—Edward K. Look
*Assistant Examiner*—Ninh Nguyen
*Attorney, Agent, or Firm*—Herbert L. Lerner; Laurence A. Greenberg; Werner H. Stemer

[57] ABSTRACT

A transition element between components of a flue-gas duct of a gas turbine includes a first heat-insulation element for reducing material stresses between the components during operation of the gas turbine. The thickness of the heat-insulation element varies as a function of a spatial variable along the flue-gas duct, to set a prescribed temperature profile in a transition region. A second heat-insulation element is provided for permitting a transition from an internally insulated component to an externally insulated component. The thickness of the second heat-insulation element varies in the opposite direction to the thickness of the first heat-insulation element.

4 Claims, 2 Drawing Sheets

TRANSITION ELEMENT BETWEEN COMPONENTS OF A FLUE-GAS DUCT OF A GAS TURBINE

CROSS-REFERENCE TO RELATED APPLICATION

This application is a continuation of International Application No. PCT/DE96/01980, filed Oct. 17, 1996, which designated the United States.

BACKGROUND OF THE INVENTION

FIELD OF THE INVENTION

The invention relates to a transition element between components of a flue-gas duct disposed downstream of a gas turbine of a power station plant.

Gas turbines are used in many sectors, in particular in power station plants, for driving generators or machines. In that case, the energy content of the fuel is utilized to produce rotary movement of a turbine shaft. To that end, a working medium or hot gas resulting during the combustion of the fuel is expanded in the gas turbine and then fed as exhaust gas or flue gas to a flue-gas duct attached to the gas turbine.

The flue-gas duct of the gas turbine normally includes a plurality of components or duct pieces connected to one another. Depending on the structure and mode of application of the gas turbine, a diffuser, a compensator and/or further elements, such as, for example, a main flue and a bypass flue, are provided as the components.

Each component is normally heated during operation of the gas turbine by the exhaust gas or flue gas flowing through it. In the process, the flue gas cools down in the flue-gas direction by heat exchange with the respective components. Each component is therefore heated to a different temperature depending on its position in the flue-gas duct. Thus, structural parts which are heated to a different temperature level bear against one another in the region of the transition between two components, which leads to mechanical stresses between the components. In particular, during changes of load at the gas turbine, such as during starting operations for example, a transient temperature load may result in considerable stressing of the components of the flue-gas duct. Damage to the components of the flue-gas duct caused thereby results in a reduction in the service life of the entire gas-turbine plant, which leads to an extremely undesirable reduction in the availability of the gas-turbine plant. An exhaust collector which is known from French Published Patent Application 2 469 563, corresponding to U.S. Pat. No. 4,391,566, is connected downstream of a gas turbine and has a heat-insulation element for the insulation of installed components against flue gas heat.

SUMMARY OF THE INVENTION

It is accordingly an object of the invention to provide a transition element between components of a flue-gas duct of a gas turbine, which overcomes the hereinafore-mentioned disadvantages of the heretofore-known devices of this general type and which permits an especially long service life of the components and thus of the entire gas-turbine plant.

With the foregoing and other objects in view there is provided, in accordance with the invention, in a power station plant including a gas turbine and a flue-gas duct disposed downstream of the gas turbine and having components, a transition element between the components, comprising a first heat-insulation element having a transition region and a thickness linearly dependent on a spatial coordinate or variable along the flue-gas duct, for setting a temperature profile in the transition region.

The invention starts out from the idea that abrupt jumps in temperature between adjacent components of the flue-gas duct should be avoided for the sake of a long service life of the components. This can be achieved by a temperature profile which changes slowly in the region of the transition between two components of the flue-gas duct in each case. The setting of a suitable temperature profile can accordingly be effected by an appropriately modified heat-insulation element by virtue of its thickness varying as a function of the spatial variable along the flue-gas duct.

In accordance with another feature of the invention, the set temperature profile is continuous in order to provide an especially effective reduction in transient temperature loads on the components. To this end, the heat insulation could have a stepped construction. However, in order to set a temperature profile which is especially suitable for avoiding material stresses, a heat insulation which is not stepped should be used. In this case, the thickness of the heat-insulation element should be linearly dependent upon the spatial coordinate. In addition, such a transition element can be manufactured in an especially simple manner.

In order to prevent local temperature fluctuations in the components in an especially effective manner and thus to increase the service life of the components in an especially effective manner, the length of the transition region is preferably greater than the temperature-decay length of the wall material of the components. In this case, the temperature-decay length is the physical characteristic for describing a local temperature change within a material.

In accordance with a further feature of the invention, the periphery of at least one of the components varies linearly with the spatial variable in at least one section of the flue-gas duct. In this way, a transient temperature load on the wall material of the components is reduced. This section therefore has a conical construction in the case of a round cross-section of the flue-gas duct. However, in the case of a quadrilateral cross-section of the flue-gas duct, the section corresponds to a circumferential surface of a truncated pyramid.

In accordance with a concomitant feature of the invention, in order to permit a connection between an internally insulated component of the flue-gas duct and an externally insulated component of the flue-gas duct, the transition element in the transition region has the first heat-insulation element acting as an internal insulation and a second heat-insulation element acting as an external insulation, and the thicknesses of the heat-insulation elements vary in opposite directions as a function of the spatial variable.

The advantages achieved by the invention are in particular the fact that a temperature profile occurs during operation of the gas turbine by virtue of the varying thickness of the heat-insulation element, in such a way that excessive material loads on the components of the flue-gas duct are avoided. Radial constraints resulting from different thermal expansions of different components can in particular also be compensated for by the section in which the periphery of at least one of the components varies linearly with the spatial variable.

Additional stressing of the components of the flue-gas duct due to the stresses occurring as a result of a transient temperature load is therefore also avoided in particular during a change of load at the gas turbine. The permissible number of cycles of the gas turbine is thus increased, which gives rise to a prolonged service life.

Other features which are considered as characteristic for the invention are set forth in the appended claims.

Although the invention is illustrated and described herein as embodied in a transition element between components of a flue-gas duct of a gas turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
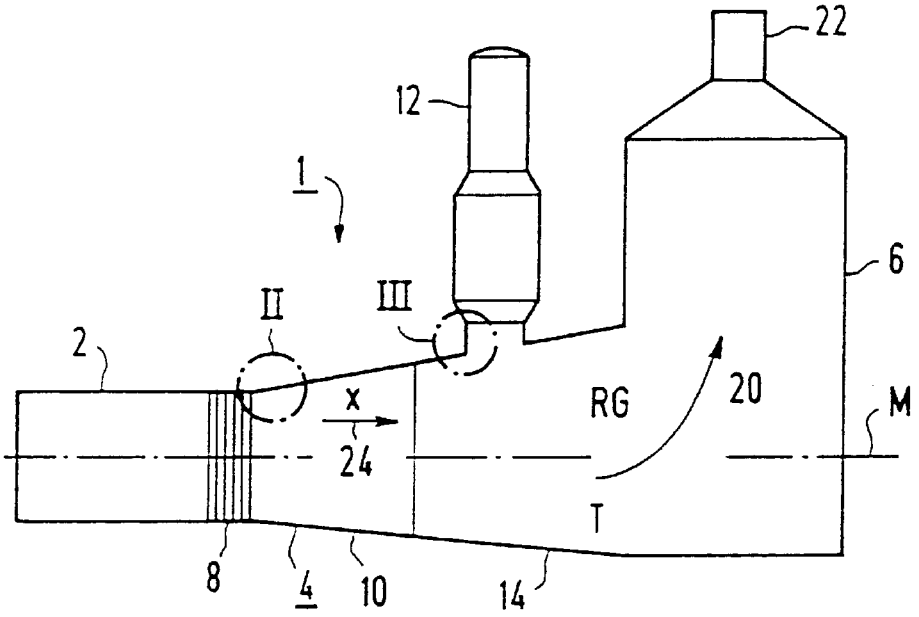
FIG. 1 is a diagrammatic, side-elevational view a gas turbine having a flue-gas duct leading into a waste-heat boiler.

Referring now in detail to the figures of the drawings, in which parts corresponding to one another are provided with the same reference symbols, and first, particularly, to FIG. 1 thereof, there is seen a gas-turbine plant 1 having a waste-heat boiler 6 for the generation of steam, e.g. for a non-illustrated steam turbine, as part of a power station plant. The waste-heat boiler 6 is disposed downstream of a gas turbine 2 through a flue-gas duct 4. The flue-gas duct 4 includes components or duct pieces, namely a metal compensator 8, a diffuser 10, a bypass flue 12 and a duct piece 14 leading into the waste-heat boiler 6.

During operation of the gas-turbine plant 1, hot flue gas RG issuing from the gas turbine 2 flows through the flue-gas duct 4 in the direction of an arrow 20 into the waste-heat boiler 6. The flue gas RG which is cooled down in the waste-heat boiler 6 during the generation of steam leaves the waste-heat boiler 6 through its flue 22.

The velocity of the hot flue gas RG issuing axially from the gas turbine 2 is reduced in the diffuser 10 connected to the metal compensator 8, so that the static flue-gas pressure increases. Thermal expansions develop due to the high discharge temperature of the hot flue gas RG of about 500 to 600° C. The thermal expansions are to be compensated for by the metal compensator 8. Furthermore, due to continuous cooling of the flue gas RG along a spatial coordinate x (indicated by an arrow 24) in the direction of the flue-gas duct 4, local and/or transient temperature loads occur at connecting points between each two components 8 and 10 as well as 12 and 14 of the flue-gas duct 4.

Figure 2:
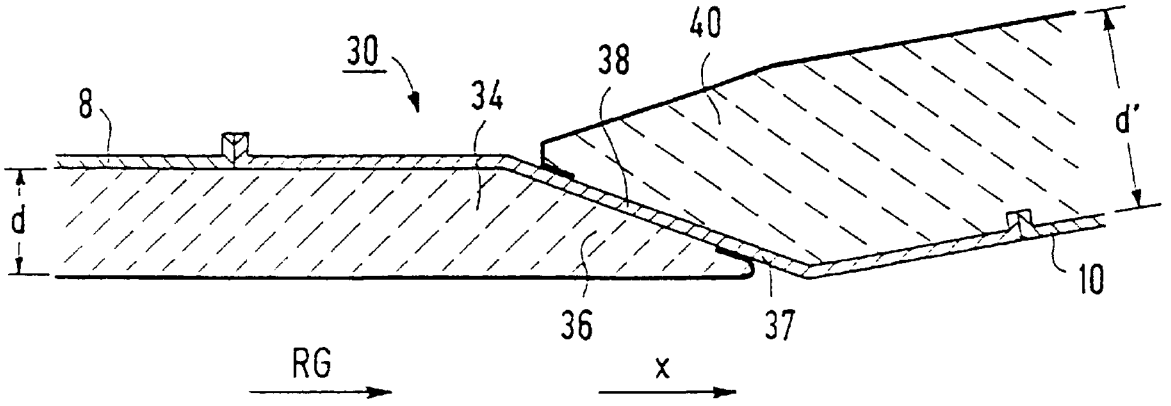
FIGS. 2 and 3 are enlarged, fragmentary, longitudinal-sectional views of respective portions II and III of FIG. 1, each illustrating a transition element between two components at two different points along the flue-gas duct of the gas turbine.
Figure 3:
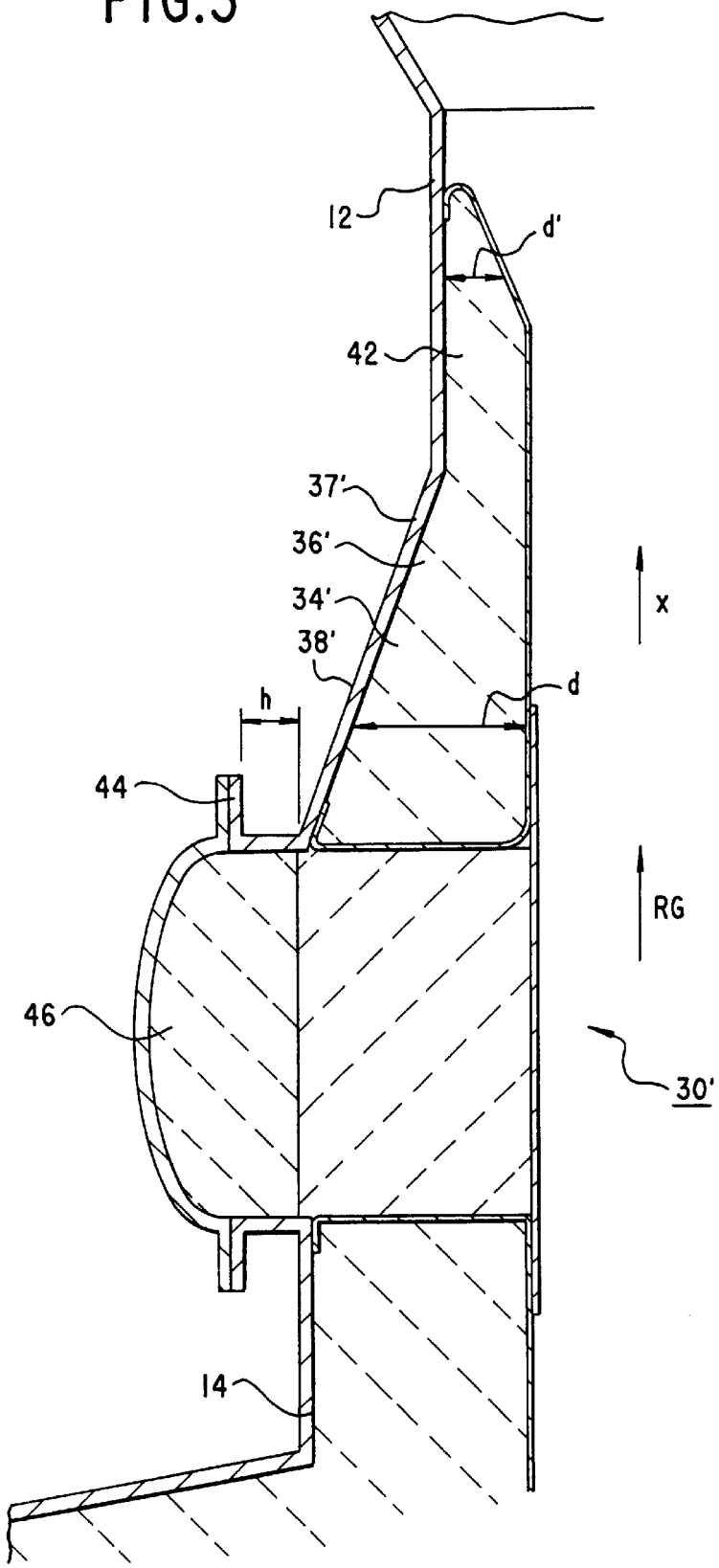

In order to compensate for such thermal stresses caused by temperature loads and to avoid resulting damage to the components 8 and 10 as well as 12 and 14 of the flue-gas duct 4, the flue-gas duct 4 has a transition element 30 at a connecting point between the components 8 and 10 as shown in the fragmentary view of FIG. 2, as well as a transition element 30' at a connecting point between the components 12 and 14 as shown in the fragmentary view of FIG. 3. The transition elements 30, 30' respectively serve to interconnect two components 8 and 10 as well as 12 and 14 of the flue-gas duct 4. In this case, the transition elements 30, 30' may also be part of one of the components 8, 10 or 12, 14, respectively. Corresponding non-illustrated transition elements 30, 30' are also provided at other connecting points for two duct pieces of the flue-gas duct 4.

The transition element 30 shown in FIG. 2 contains a first heat-insulation element 34 to set a temperature profile along the spatial coordinate x during operation of the gas turbine 2. A thickness d of the heat-insulation element 34 decreases linearly as a function of the spatial variable x in a transition region 36. A "smooth" temperature transition between the components 8 and 10 is ensured by the continuous temperature profile which thus appears, and reduced stress loading of the components 8 and 10 is thereby ensured.

The periphery of the transition element 30 is measured at an outer wall 38 of the flue-gas duct 4. The periphery decreases linearly in a section 37 of the outer wall 38. A conical structure of the outer wall 38 in the section 37 is thus obtained in the case of a round cross-section of the flue-gas duct 4. Alternatively, however, the corresponding periphery of the components 8 and 10 may also vary linearly.

In order to permit the transition from an internally insulated component 8 to an externally insulated component 10, the transition element 30 has a second heat-insulation element 40. A thickness d' of the second heat-insulation element 40 varies in the opposite direction to the thickness d of the first heat-insulation element 34, as a function of the spatial variable x.

A heat-insulation element 34' of the transition element 30' according to FIG. 3 also has a thickness d varying as a function of the spatial coordinate x, to set an intended temperature profile. In addition, the thickness d' of the heat-insulation element 34' also varies linearly in a second region 42 as a function of the spatial coordinate x. Turbulence of the flue gas RG flowing through the flue-gas duct 4 and flow losses resulting therefrom are therefore kept to a minimum. An outer wall 38' of the transition element 30' has a periphery which varies linearly with the spatial variable x in a section 37' and leads into a flange 44 having an especially small flange height h. The flange 44 is less sensitive to thermal expansions and therefore has an especially long service life by virtue of such a small flange height h.

In addition, the transition element 30' has a fabric compensator 46 which is attached to the flange 44 and is especially flexible with regard to temperature-induced distortions.

We claim:

1. In a power station plant including a gas turbine and a flue-gas duct disposed downstream of the gas turbine and having components, a transition element between the components, comprising:

a heat-insulation element having a transition region and a thickness linearly dependent on a spatial coordinate along the flue-gas duct, for setting a temperature profile in said transition region.

2. The transition element according to claim 1, wherein the set temperature profile is continuous.

3. The transition element according to claim 1, wherein the flue-gas duct has at least one section, and at least one of the components has a periphery varying linearly with the spatial variable in the at least one section.

4. The transition element according to claim 1, including another heat-insulation element having a thickness, said thicknesses of said two heat-insulation elements varying in opposite directions in said transition region, for changing from an internally insulated component to an externally insulated component.

* * * * *